US007802670B2

(12) United States Patent
Dürrer et al.

(10) Patent No.: US 7,802,670 B2
(45) Date of Patent: Sep. 28, 2010

(54) HAND RAIL AND GUIDE RAIL FOR PASSENGER CONVEYANCE SYSTEM

(75) Inventors: Albrecht Dürrer, Bad Vöslau (AT); Herwig Miessbacher, Grosslobming (AT)

(73) Assignee: Semperit AG Holding (AT)

( * ) Notice: Subject to any disclaimer, the term of this patent is extended or adjusted under 35 U.S.C. 154(b) by 396 days.

(21) Appl. No.: 11/663,012

(22) PCT Filed: Aug. 30, 2005

(86) PCT No.: PCT/EP2005/009331

§ 371 (c)(1), (2), (4) Date: Nov. 29, 2007

(87) PCT Pub. No.: WO2006/029706

PCT Pub. Date: Mar. 23, 2006

(65) Prior Publication Data

US 2009/0071798 A1 Mar. 19, 2009

(30) Foreign Application Priority Data

Sep. 16, 2004 (DE) ..... 10 2004 044 951

(51) Int. Cl.
*B66B 23/24* (2006.01)

(52) U.S. Cl. ..... 198/337; 198/335; 198/336

(58) Field of Classification Search ..... 198/335, 198/336, 337

See application file for complete search history.

(56) References Cited

U.S. PATENT DOCUMENTS

| | | | | |
|---|---|---|---|---|
| 1,101,209 A | | 6/1914 | Pitt | |
| 2,879,881 A | | 3/1959 | Tilton | |
| 4,836,353 A | * | 6/1989 | Adrian et al. | 198/335 |
| 4,946,020 A | * | 8/1990 | Rivera et al. | 198/335 |
| 5,033,607 A | * | 7/1991 | Rivera | 198/335 |
| 5,160,009 A | * | 11/1992 | Iyoda et al. | 198/337 |
| 5,226,522 A | * | 7/1993 | Johnson et al. | 198/335 |
| 5,255,772 A | * | 10/1993 | Ball et al. | 198/337 |
| 6,047,809 A | * | 4/2000 | Idetsuki | 198/337 |
| 6,237,740 B1 | * | 5/2001 | Weatherall et al. | 198/337 |
| 6,564,921 B1 | * | 5/2003 | Gorczyca | 198/324 |
| 6,673,431 B1 | * | 1/2004 | Ledzinski | 428/292.1 |
| 6,761,259 B1 | * | 7/2004 | Onodera et al. | 198/335 |
| 7,200,915 B2 | * | 4/2007 | Keun | 29/527.1 |
| 7,243,775 B2 | * | 7/2007 | Novacek et al. | 198/337 |

FOREIGN PATENT DOCUMENTS

| | | |
|---|---|---|
| DE | 577801 | 6/1933 |
| DE | 2100772 | 7/1971 |
| DE | 29903376 | 9/1999 |
| FR | 1340585 | 12/1962 |
| JP | 10316348 | 12/1998 |
| JP | 2001171966 | 6/2001 |
| JP | 2003321185 | 11/2003 |
| JP | 2003335490 | 11/2003 |

* cited by examiner

*Primary Examiner*—Douglas A Hess
(74) *Attorney, Agent, or Firm*—Cantor Colburn LLP

(57) ABSTRACT

Disclosed is a hand rail for a passenger conveying installation, such as e.g. an escaltor or a passenger conveyor, which has a flexible base body with two side lips for engaging around a guide rail, and in which at least one of the side lips has a profiled section, which may be guided in a track or guide groove of the guied rail, which secures the hand rail against slipping off the guide rail, characterised in that the profiled section of the side lips has a bulge-like thickening.

18 Claims, 1 Drawing Sheet

HAND RAIL AND GUIDE RAIL FOR PASSENGER CONVEYANCE SYSTEM

The present invention relates to a hand rail for a passenger conveying installation such as e.g. an escalator or passenger conveyor. The invention further relates to a guide rail for such a hand rail and a side covering of a passenger conveying installation with a balustrade, a guide rail fixed thereto and a hand rail guided on the guide rail.

Installations for conveying passengers, whether escalators or passenger conveyors, are usually provided on each side with an endless moving hand rail, which is driven synchronously with the conveying installation carrying the passengers. The hand rail is guided in a guide rail mounted on a balustrade. The return belt and the drive for the hand rail can either be enclosed in the balustrade, or disposed under or next to the same.

The hand rails used for this purpose are conventionally composed of a flexible material in order to permit the hand rail to revolve around corresponding guide and drive rollers.

Conventionally, the hand rail has a C-shaped cross-section and therefore consists of a middle part and two side lips which engage around the guide rail. In order that the hand rail cannot be pulled off the guide rail, it requires a specific transverse rigidity, in particular in the region of the lips. The hand rail must therefore be flexible in the longitudinal direction and dimensionally stable in the transverse direction. In known C-shaped hand rails, therefore, usually a rubber-type material is used for the hand rail which is reinforced by additional fabric or corded layers disposed inside the cross-section. A hand rail of this type is disclosed for example in U.S. Pat. No. 5,255,772. The transverse rigidity is in this case afforded by plural intermediate layers of a relatively hard material. The manufacture of such a hand rail with plural transverse stiffening inserts is complex and expensive.

DE 21 00 772 discloses a hand rail composed of a flexible base body, which has a middle part and edge parts, the edges being pivotable via hinges about the middle part. During mounting on the guide rail, the edges are folded under the flanges of the guide in order to permit bending of the hand rail in both directions around discs of a driving and guiding installation.

In U.S. Pat. No. 2,879,881, a hand rail is disclosed which is also formed with an approximately C-shaped profile by extrusion. However, this hand rail does not slide loosely over a guide system, but is mounted on two flanges of the guide rail with which it is connected by frictional engagement. The guide rail itself is conveyed by a chain system. The flange ends of the C are widened in cross-section, which however clearly serves no particular purpose.

The object of the invention is therefore to make available a hand rail without transverse stiffening inserts and thus with a simpler structure which can nevertheless be held securely on a guide rail. This is achieved by the invention with the hand rail according to claim 1, the guide rail according to claim 16 and the side covering of a conveying installation according to claim 17.

The hand rail according to the invention is therefore characterised in that at least one of the side lips has a profiled section which is guidable in a track or guide groove of the guide rail, which fixes the hand rail against slipping off the guide rail.

The hand rail is therefore held on the guide rail by a track or guide groove formed in the guide rail. A "track" in this case refers to any device which extends in the longitudinal direction of the guide rail and which holds the profiled section on the guide rail, such as e.g. moulded webs, channels or the like.

Preferably, the profiled section is held positively in the guide groove and/or is prevented from slipping out by an undercut. Transverse stiffening of the flexible base body is therefore no longer necessary in order to keep the same on the guide rail. On the contrary, the side lips may be fully flexible and pivotable relative to a middle region of the base body. Thus the hand rail can easily be fitted into the track and guided.

In a first preferred embodiment, the side lips have a bulge-like thickening which can be located and guided with positive locking in a corresponding track of the guide rail. Alternatively, the side lips have a bent section which forms an undercut with a corresponding flange of the guide rail. A third embodiment is also conceived, in which the side lips have no thickening or the like but whose ends have a constant thickness. When the material of the hand rail is selected to be not too soft or compressible, such a profile can be guided in a corresponding track of the guide rail without slipping out.

During its revolving motion, the profiled section slides in the track of the generally stationary guide rail. Therefore, the track or guide groove and the profiled section are preferably provided with a surface having a low coefficient of friction. Preferably, the profiled section of the side lips is covered with a special sliding covering. This consists, e.g. of a woven, knitted or braided fabric composed of textile or plastics material. Just such a sliding covering is preferably also provided between the guide rail and the flexible base body.

The flexible base body is preferably manufactured as a flat, belt-like structure with a constant or continuously changing thickness, e.g. by extrusion, but may also be C-shaped. Preferably, it is manufactured from a cross-linked or thermoplastic elastomer material. Preferable cross-linked elastomer materials have a base of natural or synthetic rubber, and suitable thermoplastic elastomer materials are for example the elastomers cited in ISO 18064 such as TPE-U, TPE-V, TPE-O, TPE-S, TPE-A or TPE-E. In this case, the base body may either consist uniformly of one elastomer material over its entire cross-section, or of a uniform core material and a softer or harder outer layer. The outer layer may be coloured, provided with an imprint, with a surface structure or a surface finish. Such a finish may have e.g. an anti-microbial effect or be provided with aromatic substances. Alternatively, the uniform base material of the base body may also be imprinted or provided with a surface structure or finish. Particularly preferably, the surface structure is particularly easy to grip in haptic terms.

In a preferred embodiment, the flexible base body has a tie beam extending in the longitudinal direction, which may be manufactured e.g. from one or more metal strips or from steel or textile cords. These are preferably embedded in the base body. The tie beam is used to absorb tension stresses in the longitudinal direction of the hand rail.

In a further embodiment, the elastomer base body consists of one or more elastomer materials, in which case either a uniform core material with a different casing material or a cover plate forming the hand support face with a different under-batten form the base body.

According to a further aspect, the invention is aimed at a guide rail for the hand rail of a passenger conveying installation which has a substantially T-shaped profile with an upper crossbeam. The guide rail has, under the crossbeam, a track or guide groove on both sides, in which the profiled section of the side lips of the hand rail may be guided. Thus the hand rail is prevented from slipping off the guide rail. Preferably, the hand rail is held in the track by an undercut, which may be formed e.g. by a web or flange extending in the longitudinal direction.

The guide rail may be manufactured from metal, e.g. aluminium, or from plastics material such as PA.

Further, the invention is aimed at a side covering of a passenger conveying installation on whose balustrade the guide rail is fixed.

The invention will now be described more fully with the aid of preferred embodiments with reference to the attached drawings.

Figure 1:
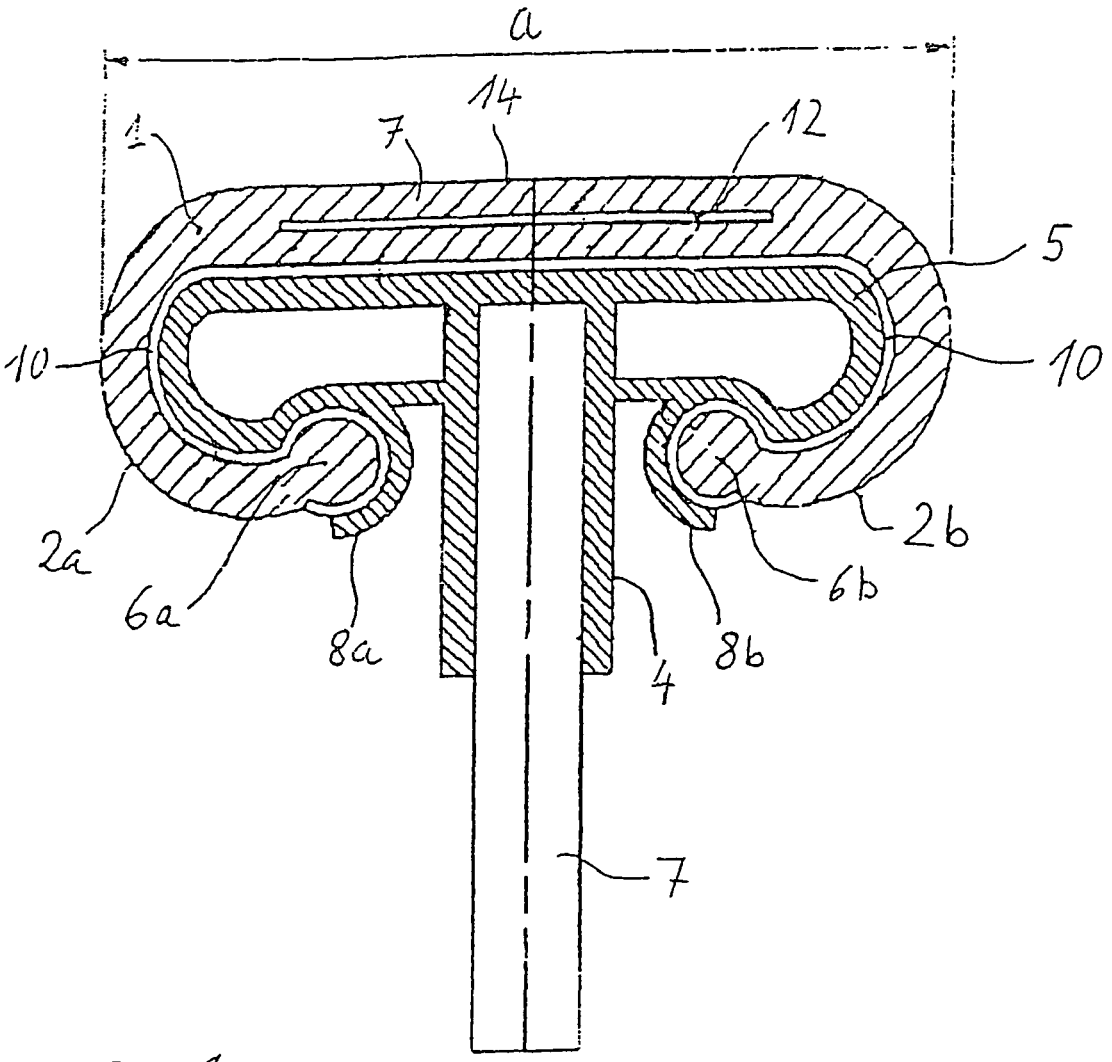
FIG. 1 shows a cross-section through the guide rail with the hand rail mounted thereon according to a first embodiment of the invention.

On FIG. 1, the upper part of a glass balustrade 7 can still be seen. To this is fixed a guide rail 4 composed of plastics material or metal, which has approximately a T-shaped cross-section. For the purpose of saving material, the lateral wings of the crossbeam 5 are hollow. On the exterior, the guide rail has a surface or surface coating which has as low a coefficient of friction as possible. On the underside of the two crossbeams 5, the guide element in each case has a moulded web 8*a*, 8*b*, which together with the underside of the crossbeam forms a track or guide groove.

The hand rail of C-shaped cross-section consists substantially of a flexible base body 1, which with its flexible side lips 2*a*, 2*b* engages around the crossbeam 5 of the guide rail. At the ends of the lips, there are thickenings 6*a*, 6*b* which are inserted into the guide grooves of the guide rail and are held there with positive locking against lateral slipping out. Preferably the undercut of the guide groove or track is so small that the bulge-like thickenings 6*a*, 6*b* can be pressed with moderate force into their respective track. According to the formation of the track and of the undercut, the force which secures the lips against slipping out may be greater than the force required for pressing in. At the same time, the friction contact between the thickenings 6*a*, 6*b* and the moulded webs 8*a*, 8*b* is relatively low so that the hand rail can slide over the guide rail.

On the side associated with the guide rail, the flexible base body is covered with a sliding covering composed of a textile braid or plastics coating with a low coefficient of friction. Due to the lack of transverse stiffening, the hand rail fits snugly on to the guide rail. Therefore, the guide rail now serves the purpose of supporting the hand rail against the pressure of the person being conveyed.

On the other side is a hand support face 14. This is formed to be visually appealing with a coloured imprint and/or is provided with a surface structure which is easy to grip. The flexible base body can also be covered with a further coating, which e.g. has anti-microbial properties and is impregnated with aromatic substances.

Only in the middle region of the flexible base body is this reinforced with a tie beam 12 of steel, cord or sheet metal. The regions extending beyond the central region with the tie beam are therefore flexible and abut the crossbeam of the guide rail, whilst they are held at their ends 6*a*, 6*b* by the longitudinal webs 8*a*, 8*b* on the underside of the guide rail. The flexible base body may have both a C-shaped original shape and be manufactured as a flat band-shaped formation. Dimensional stability is not necessary.

Figure 2:
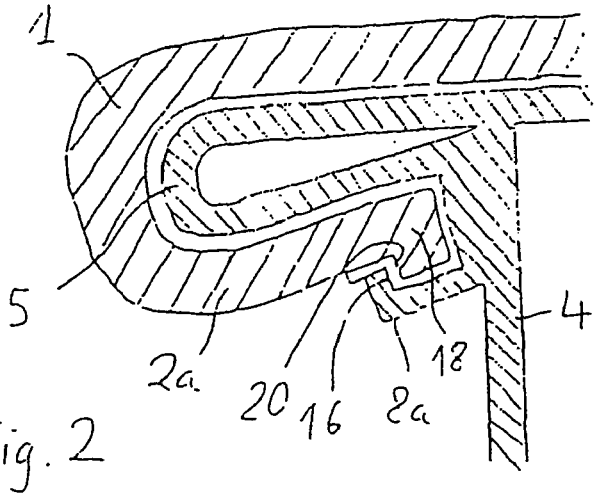
FIG. 2 shows a partial cross-section through a guide rail with the hand rail mounted thereon according to a second embodiment of the invention.

In FIG. 2, an alternative embodiment is shown. Corresponding parts are in this case characterised by the same reference numbers as in FIG. 1. The side lip 2*a* of the flexible base body in this case has no thickening at its end but a region of uniform thickness with a head member 18, which is bent however at 90° relative to the lip. This structure can also be manufactured by extrusion. Thus at the end of the lip a kind of projection 20 is formed. On the guide rail 4, a correspondingly formed guide web 8*a* is disposed. This is likewise bent over at its end and thus forms an undercut 16, which cooperates with the projection 20 in order to prevent the head 18 from slipping out. Thus a positive connection is created between the flexible base body and the guide rail 4.

The driving of the hand rail is effected e.g. by a wide friction wheel or by a print roller drive (not shown).

The invention claimed is:

1. Hand rail for a passenger conveying installation, such as e.g. an escalator or a passenger conveyor, which has a flexible base body with two side lips for engaging around a guide rail (4), which may be guided in a track or guide groove of the guide rail, which secures the hand rail against slipping off the guide rail, that the hand rail comprising:

a profiled section included with at least one of the side lips, the profiled section having a thickening, wherein the profiled section is held positively in the guide groove of the guide rail, wherein the guide groove bends around and holds at least a portion of an outer surface of the profiled section at the thickening, the guide groove cooperating with the profiled section.

2. Hand rail according to claim 1, wherein the side lips have no transverse stiffeners.

3. Hand rail according to claim 1, wherein the profiled section of the side lips is covered with a sliding covering.

4. Hand rail according to claim 3, wherein the sliding covering comprises a woven, knitted or braided fabric.

5. Hand rail according to claim 3, wherein the sliding covering comprises a plastics material with a low coefficient of friction.

6. Hand rail according to claim 1, wherein the flexible base body is covered on the side facing the guide rail with a sliding covering.

7. Hand rail according to claim 1, wherein the flexible base body is manufactured from at least one elastomer material such as e.g. a cross-linked or thermoplastic elastomer material.

8. Hand rail according to claim 7, wherein the flexible base body uniformly comprises the elastomer material throughout its entire cross-section.

9. Hand rail according to claim 1, wherein the flexible base body has a tie beam which extends in the longitudinal direction and which is manufactured for example from a metal strip or from steel or textile cord.

10. Hand rail according to claim 1, wherein the hand rail has on the side remote from the guide rail a hand support face, which is provided with a surface structure that is easy to grip.

11. Hand rail according to claim 1, wherein the hand rail has on the side remote from the guide rail a hand support face, which is formed coloured.

12. Hand rail according to claim 1, wherein the flexible base body is formed by a flat strip, which is manufactured in particular by extrusion.

13. Guide rail for the hand rail of a passenger conveying installation according to claim 1, which has a substantially T-shaped profile with an upper crossbeam, wherein the guide rail has under the crossbeam on both sides a track or guide groove in which the profiled section of the side lips of the hand rail may be guided.

14. Side covering of a passenger conveying installation, comprising:

a balustrade a guide rail fixed to the balustrade, and a hand rail guided on the guide rail according to claim 1.

15. Hand rail according to claim 1, wherein the profiled section is held positively in the guide groove of the guide rail via an interference fit.

16. Hand rail according to claim 1, wherein the profiled section includes a rounded thickening.

17. Hand rail for a passenger conveying installation, such as e.g. an escalator or a passenger conveyor, which has a flexible base body with two side lips for engaging around a guide rail, which may be guided in a guide track of the guide rail, which secures the hand rail against slipping off the guide rail, that the hand rail comprising:

a profiled section included with at least one of the side lips, the profiled section having a thickening at an end thereof, wherein the guide track includes a groove portion configured to hold an inner surface of the profiled section at the thickening, and a flange portion configured to hold an outer surface of the profiled section at the thickening, the profiled section being held positively in the guide track of the guide rail via the groove portion and the flange portion.

18. Hand rail according to claim 17, the flange portion extending from the guide rail to an extent that is relatively beneath an entirety of the thickening.

* * * * *